US011081054B2

(12) United States Patent
Kim et al.

(10) Patent No.: US 11,081,054 B2
(45) Date of Patent: Aug. 3, 2021

(54) DISPLAY DEVICE AND METHOD OF DRIVING SAME

(71) Applicant: LG Display Co., Ltd., Seoul (KR)

(72) Inventors: Youngho Kim, Paju-si (KR); Sungjo Koo, Paju-si (KR); Yangseok Jeong, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/681,271

(22) Filed: Nov. 12, 2019

(65) Prior Publication Data

US 2020/0152128 A1 May 14, 2020

(30) Foreign Application Priority Data

Nov. 13, 2018 (KR) ..... 10-2018-0139434

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01); *G09G 2310/027* (2013.01); *G09G 2320/0285* (2013.01)

(58) Field of Classification Search
CPC .. G09G 3/3291; G09G 3/3258; G09G 3/3233; G09G 3/3266; G09G 2320/106; G09G 2320/0295; G09G 2320/0261; G09G 2320/0285; G09G 2320/0252; G09G 2320/043; G09G 2310/027
USPC ..... 345/204, 76, 87, 98–101
See application file for complete search history.

(56) References Cited

U.S. PATENT DOCUMENTS

2005/0180083 A1* 8/2005 Takahara ..... H01L 51/5262 361/152
2006/0022933 A1* 2/2006 Endo ..... G09G 3/3614 345/98
2006/0284815 A1* 12/2006 Kwon ..... G09G 3/3614 345/98
2008/0079710 A1* 4/2008 Ishii ..... G09G 3/2096 345/215
2008/0303809 A1* 12/2008 Lee ..... G09G 3/3696 345/215

FOREIGN PATENT DOCUMENTS

KR 10-2008-0001179 A 1/2008

* cited by examiner

*Primary Examiner* — Jimmy H Nguyen
(74) *Attorney, Agent, or Firm* — Seed IP Law Group LLP

(57) ABSTRACT

A display device and a method of driving the same are provided. The display device according to an embodiment of the disclosure includes: a display panel including a plurality of pixel lines in an area A, an area B, and an area C; a panel driver configured to: supply input image data to pixel lines in the area A during a first period; supply black image data to pixel lines in the area B during a second period following the first period; and supply input image data to pixel lines in the area C during a third period following the second period; and a timing controller configured to adjust a first input image data to be supplied to a last pixel line in the area A to a first adjusted data based on a first compensation table.

18 Claims, 17 Drawing Sheets

DISPLAY DEVICE AND METHOD OF DRIVING SAME

CROSS-REFERENCE TO RELATED APPLICATION

This application claims the benefit of Korea Patent Application No. 10-2018-0139434, filed on Nov. 13, 2018, which are incorporated herein by reference for all purposes as if fully set forth herein.

BACKGROUND

Technical Field

The disclosure relates to a display device and a method of driving the same.

Description of the Related Art

Flat display devices are widely used for portable computers such as laptop computers and PDAs and cellular phones as well as desktop computers since their sizes and weights can be reduced. Such display devices include a liquid crystal display (LCD), a plasma display panel (PDP), an organic light-emitting diode display, and the like. Particularly, an active matrix type organic light emitting diode display including organic light-emitting diodes (OLEDs) which spontaneously emit light has the advantages of a high response speed, high emission efficiency, high luminance and a wide viewing angle.

BRIEF SUMMARY

A black image insertion technique can be used in organic light-emitting diode displays in to reduce a motion picture response time (MPRT) and improve motion blur. The black image insertion technique displays a black image between neighboring image frames to effectively erase the image of the previous frame.

The black image insertion technique writes all input images corresponding to one frame and then inserts a black image and thus increases the duration of one frame and is not suitable for high-speed operation. Further, since the black image insertion technique sequentially writes black images in units of pixel line, a time allocated to black image writing within one frame is long and thus an input image charging time is insufficient.

In addition, when the black image insertion technique is used, bright lines having higher luminance than normal luminance or dark lines having lower luminance than the normal luminance are generated in specific pixel lines when input images are reproduced, deteriorating picture quality.

Accordingly, the disclosure provides a display device which is enhanced or optimized for high-speed operation and can be used to solve the problem of insufficient input image charging time and poor picture quality due to deterioration caused by black image insertion which is used to enhance or improve a motion picture response time, and a method of driving the same.

A display device according to one or more embodiments of the disclosure includes: a display panel having a plurality of pixel lines disposed thereon and driven in periods including at least a first period, a second period and a third period; a panel driver for sequentially writing input image data to pixel lines included in an area A of the display panel during the first period, simultaneously writing black image data to pixel lines included in an area B of the display panel during the second period following the first period, and sequentially writing input image data to pixel lines included in an area C of the display panel during the third period following the second period; and a timing controller for modulating an original value of input image data to be written to a pixel line having a write timing immediately neighboring the second period among the pixel lines of the area A or the area C to a modulated value different from the original value.

A method of driving a display device according to one or more embodiments of the disclosure, the display device including a display panel having a plurality of pixel lines disposed thereon and driven in periods including at least a first period, a second period and a third period, the method comprising: modulating an original value of input image data to be written to a pixel line having a write timing immediately neighboring the second period among the pixel lines of the area A or the area C of the display panel to a modulated value different from the original value; and sequentially writing input image data to pixel lines included in the area A of the display panel during a first period, simultaneously writing black image data to pixel lines included in an area B of the display panel during a second period following the first period, and sequentially writing input image data to pixel lines included in the area C of the display panel during a third period following the second period.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
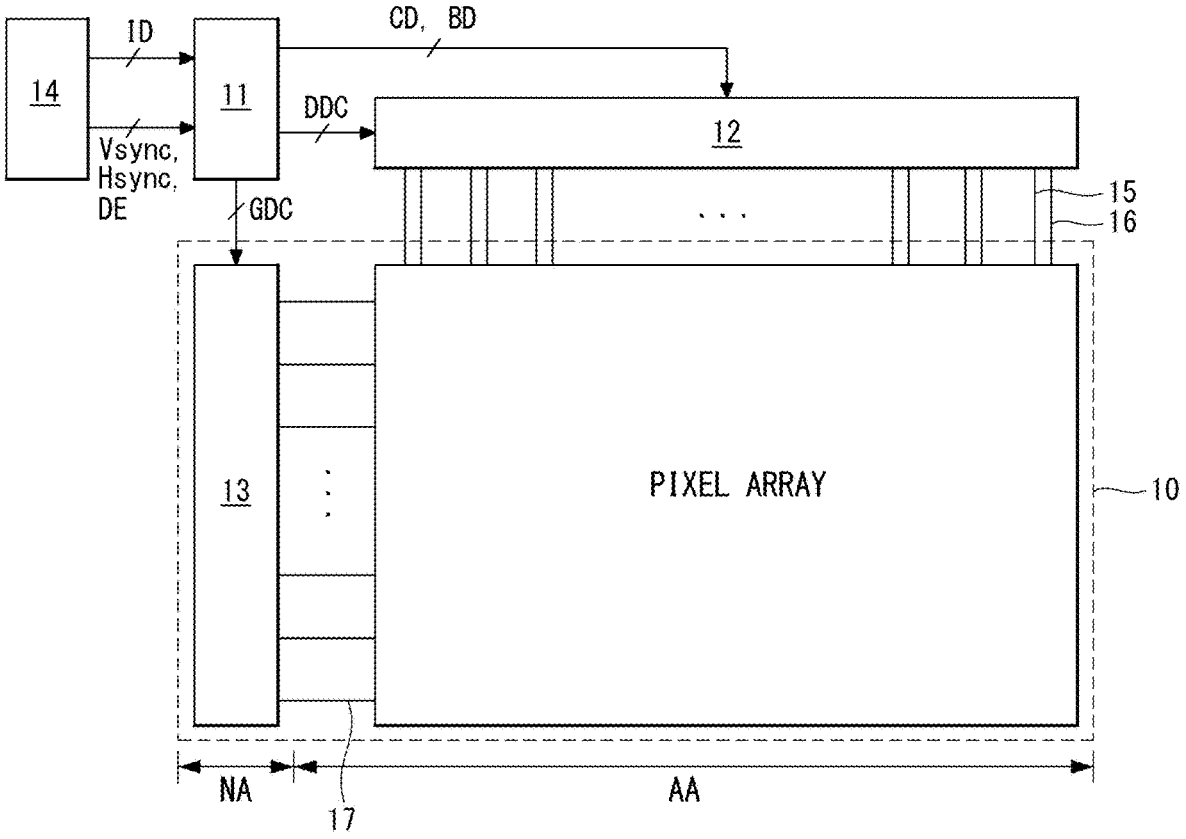
FIG. 1 is a diagram showing a display device according to one or more embodiments of the disclosure.

The advantages, features and methods for accomplishing the same of the disclosure will become more apparent through the following detailed description with respect to the accompanying drawings. However, the disclosure is not limited by embodiments described blow and is implemented in various different forms, and the embodiments are provided so that this disclosure will be thorough and complete, and will fully convey the scope of the disclosure to those skilled in the art. The disclosure is defined by the scope of the claims.

Shapes, sizes, ratios, angles, numbers, etc., shown in the figures to describe embodiments of the disclosure are exemplary and thus are not limited to particulars shown in the figures. Like numbers refer to like elements throughout the specification. It will be further understood that when the terms "include", "have" and "comprise" are used in this specification, other parts may be added unless "~only" is used. An element described in the singular form is intended to include a plurality of elements unless context clearly indicates otherwise.

In interpretation of a component, the component is interpreted as including an error range unless otherwise explicitly described.

In the description of the various embodiments of the disclosure, when describing positional relationships, for example, when the positional relationship between two parts is described using "on", "above", "below", "aside", or the like, one or more other parts may be located between the two parts unless the term "directly" or "closely" is used.

In the following description of the embodiments, "first" and "second" are used to describe various components, but such components are not limited by these terms. The terms are used to discriminate one component from another component. Accordingly, a first component mentioned in the following description may be a second component within the technical spirit of the disclosure.

The same reference numbers refer to the same components throughout this specification.

Although a pixel circuit and a gate driver formed on a substrate of a display panel can be implemented as n-type metal oxide semiconductor field effect transistor (MOSFET) TFTs in the disclosure, the disclosure is not limited thereto and may be implemented as p-type MOSFET TFTs. A TFT is a three-electrode element including a gate, a source and a drain. The source is an electrode that provides carriers to the transistor. In the TFT, carriers flow from the source. The drain is an electrode from which carries flow to the outside of the TFT. That is, carriers flow from a source to a drain in a MOSFET. In the case of an n-type TFT (NMOS), a source voltage is lower than a drain voltage such that electrons can flow from the source to the drain because the electrons are carriers. Since electrons flow from the source to the drain in the n-type TFT, current flows from the drain to the source. On the other hand, In the case of a p-type TFT (PMOS), a source voltage is higher than a drain voltage such that holes can flow from the source to the drain because the holes are carriers. Since holes flow from the source to the drain in the p-type TFT, current flows from the source to the drain. It is noted that the source and the drain of the MOSFET are not fixed. For example, the source and the drain of the MOSFET may be changed according to an applied voltage. Accordingly, one of the source and drain will be described as a first electrode and the other will be described as a second electrode in embodiments of the disclosure.

Hereinafter, embodiments of the disclosure will be described in detail with reference to the attached drawings. In the following embodiment, a display device will be described focusing on an organic light emitting diode display containing an organic light emitting material. However, the technical spirit of the disclosure is not limited thereto and may be applied to inorganic light emitting displays containing an inorganic light emitting material.

In the following description, if a detailed description of known functions or configurations associated with the display device would unnecessarily obscure the gist of the disclosure, detailed description thereof will be omitted.

Figure 2:
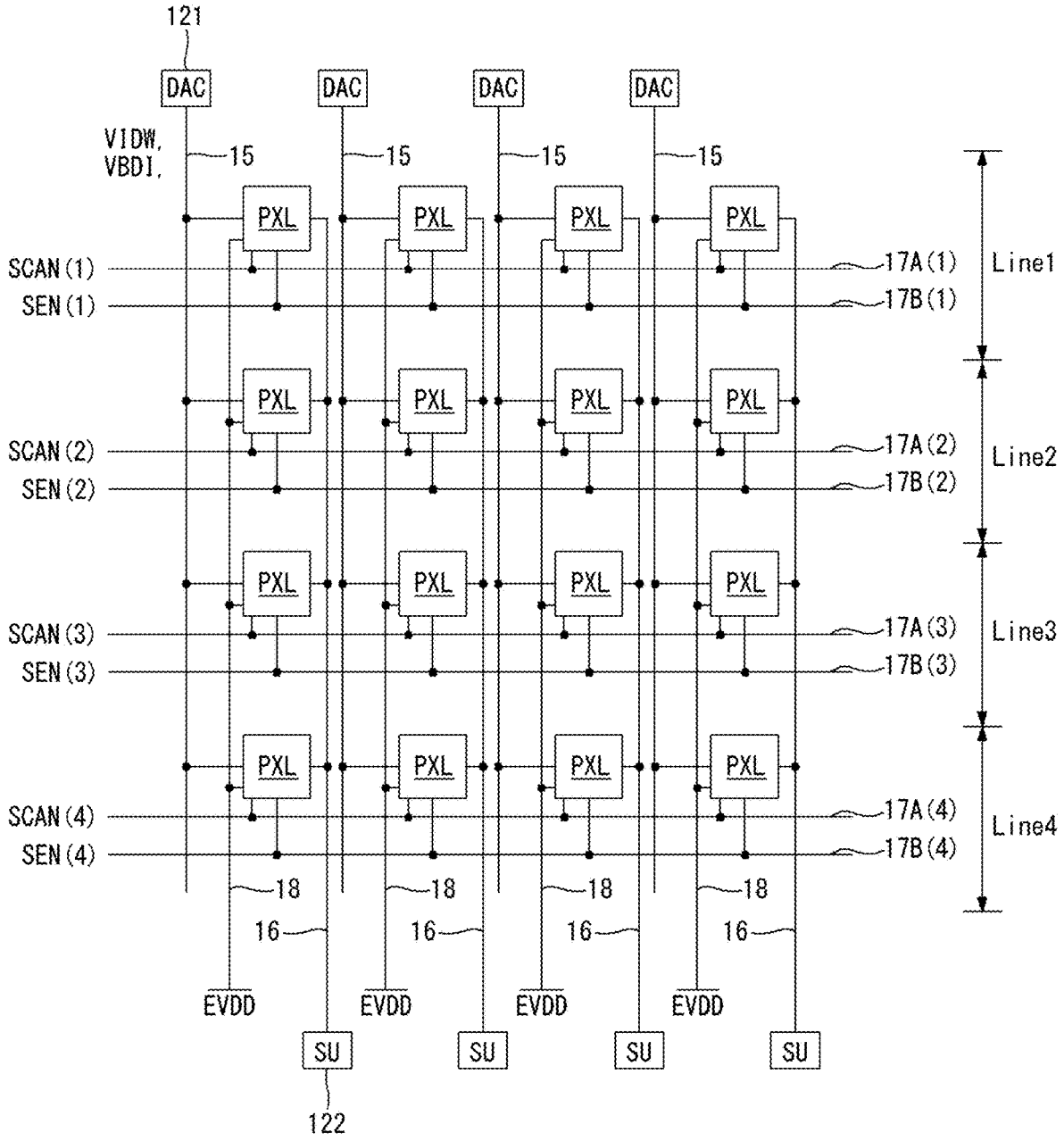
FIG. 2 is a diagram showing a pixel array included in the display device of FIG. 1.
Figure 3:
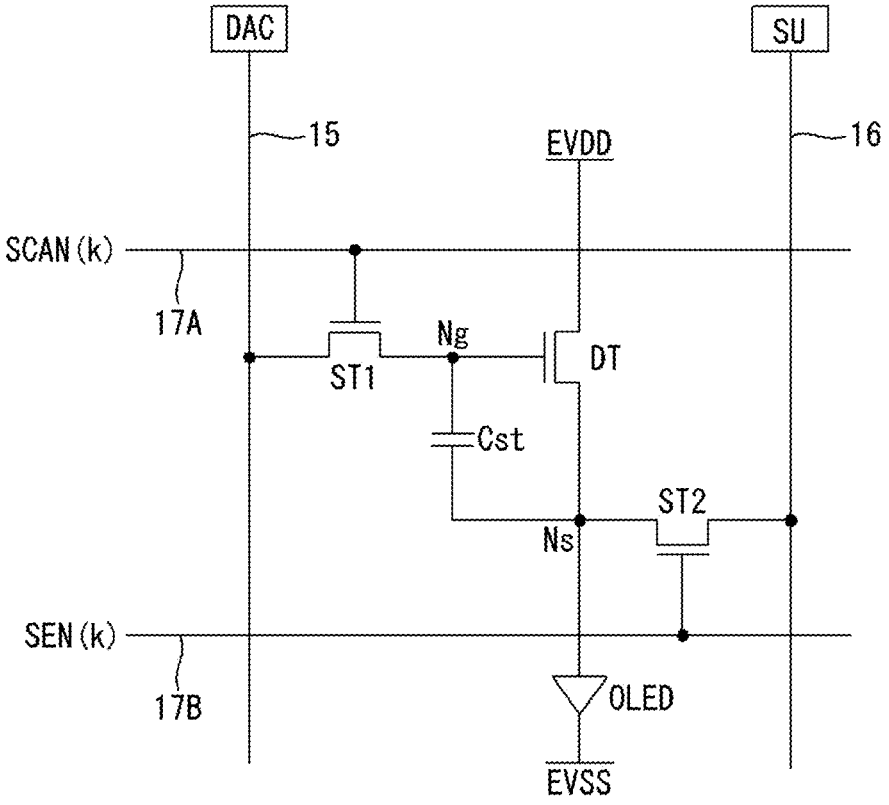
FIG. 3 is a diagram showing one pixel included in the pixel array of FIG. 2.

FIG. 1 is a diagram showing a display device according to one or more embodiments of the disclosure, FIG. 2 is a diagram showing a pixel array included in the display device of FIG. 1 and FIG. 3 is a diagram showing one pixel included in the pixel array of FIG. 2.

Referring to FIGS. 1 to 3, the display device according to one or more embodiments of the disclosure may include a display panel 10, a timing controller 11 and panel drivers 12 and 13. The panel drivers 12 and 13 includes a data driver 12 which drives data lines 15 of the display panel 10 and a gate driver 13 which drives gate lines 17 of the display panel 10.

The display panel 10 may include a plurality of data lines 15, reference voltage lines 16 and a plurality of gate lines 17. In addition, pixels PXL may be disposed at intersections of the data lines 15, the reference voltage lines 16 and the gate lines 17. A pixel array shown in FIG. 2 may be formed in a display area AA of the display panel 10 according to the pixels PXL disposed in a matrix form.

In the pixel array, the pixels PXL may be divided into lines in one direction. For example, the pixels PXL may be divided into a plurality of pixel lines Line 1 to Line 4 in a direction in which gate lines extend (or horizontal direction). Here, a pixel line refers to a set of pixels PXL neighboring in the horizontal direction instead of a physical signal line. Accordingly, pixels PXL constituting the same pixel line can be connected to the same gate lines 17A and 17B.

In the pixel array, each pixel PXL can be connected to a digital-to-analog converter (hereinafter, DAC) 121 through the data line 15 and connected to a sensing unit (SU) 122 through the reference voltage line 16. The reference voltage line 16 may be further connected to the DAC 121 in order to provide a reference voltage. Although the DAC 121 and the sensing unit SU may be included in the data driver 12, the disclosure is not limited thereto.

In the pixel array, each pixel PXL can be connected to a high-voltage pixel power supply EVDD through a power line 18. In addition, each pixel PXL can be connected to the gate driver 13 through the first and second gate lines 17A and 17B.

Each pixel PXL may be implemented as shown in FIG. 3. A pixel PXL disposed on a k-th (k is an integer) pixel line includes an OLED, a driving thin film transistor (TFT) DT, a storage capacitor Cst, a first switch TFT ST1 and a second switch TFT ST2, and the first switch TFT ST1 and the second switch TFT ST2 may be connected to the different gate lines 17A and 17B.

The OLED includes an anode connected to a source node Ns, a cathode connected to an input terminal of a low-voltage pixel power supply EVSS, and an organic compound layer disposed between the anode and the cathode. The driving TFT DT controls a driving current flowing through the OLED according to a voltage difference between a gate node Ng and the source node Ns. The driving TFT DT includes a gate electrode connected to the gate node Ng, a first electrode connected to the high-voltage pixel power supply EVDD, and a second electrode connected to the source node Ns. The storage capacitor Cst is connected between the gate node Ng and the source node Ns and stores a gate-source voltage of the driving TFT DT.

The first switch TFT ST1 is turned on according to a scan signal SCAN(k) to apply a data voltage charged in the data line 15 to the gate node Ng. The first switch TFT ST1 includes a gate electrode connected to the first gate line 17A, a first electrode connected to the data line 15, and a second electrode connected to the gate node Ng. The second switch TFT ST2 is turned on according to a sense signal SEN(k) to apply a reference voltage charged in the reference voltage line 16 to the source node Ns or transmit a voltage variation at the source node Ns according to a pixel current to the reference voltage line 16. The second switch TFT ST2 includes a gate electrode connected to the second gate line 17B, a first electrode connected to the reference voltage line 16, and a second electrode connected to the source node Ns.

The number of gate lines 17 connected to each pixel PXL may depend on a pixel structure. For example, the number of gate lines 17 connected to each pixel PXL is 2 in the case of a 2-scan pixel structure in which the first switch TFT ST1 and the second switch TFT ST2 are operated in different manners. In the 2-scan pixel structure, each gate line 17 includes the first gate line 17A to which a scan signal is applied and the second gate line 17B to which a sense signal is applied. Although the 2-scan pixel structure is exemplified in the following description for convenience, the technical spirit of the disclosure is not limited to the pixel structure or the number of gate lines.

The timing controller 11 can generate a data control signal DDC for controlling operation timing of the data driver 12 and a gate control signal GDC for controlling operation timing of the gate driver 13 on the basis of timing signals such as a vertical synchronization signal Vsync, a horizontal synchronization signal Hsync, a dot clock signal DCLK and a data enable signal DE input from a host system 14. The gate control signal GDC may include a gate start signal, gate shift clocks, and the like. The data control signal DDC includes a source start pulse signal, a source sampling clock signal, a source output enable signal, and the like. The source start pulse signal controls a data sampling start timing of the data driver 12. The source sampling clock signal controls a sampling timing of data on the basis of a rising or falling edge thereof. The source output enable signal controls an output timing of the data driver 12.

The timing controller 11 can control display driving timing with respect to pixel lines of the display panel 10 on the basis of the timing control signals GDC and DDC.

Display driving is an operation of starting to write input image data ID and specific image data BD to pixel lines Line 1 to Line 4 with a predetermined time difference within one frame to sequentially reproduce an input image and a black image on the display panel 10. Here, the specific image data BD is low grayscale image data for displaying a black image on the display panel 10. The specific image data BD includes grayscale value 0 for a full black image to predetermined grayscale values for images close to the black image. In the following description, such low grayscale image data will be referred to as "black image data" for convenience.

Display driving includes image data writing (IDW) for writing input image data ID to pixel lines and black data insertion (BDI) for writing black image data BD to pixel lines. BDI can be started before IDW ends within one frame such that a display device optimized for high-speed operation can be realized. That is, IDW for a first pixel line and BDI for a second pixel line may temporarily overlap within one frame.

The timing controller 11 can adjust a time difference between IDW start timing and BDI start timing, that is, an emission duty, by controlling the BDI start timing within one frame.

The timing controller 11 can control BDI start timing within one frame in connection with motion of input image data ID. The timing controller 11 can detect motion of the input image data ID through various known video processing techniques and then advance the BDI start timing within one frame when a motion variation in the input image data ID is large, to thereby reduce the emission duty. Accordingly, MPRT performance can be improved and motion blurring can be alleviated when an abrupt image change occurs. On the other hand, when there is no image change, a maximum instantaneous luminance of pixels can be reduced by delaying the BDI starting timing and increasing the emission duty.

The timing controller 11 can realize IDW in a vertical active period of one frame and realize BDI using both the vertical active period and a vertical blank period. Accordingly, BDI timing can overlap with IDW timing in the vertical active period.

The timing controller 11 outputs gate shift clocks including carry clocks, scan clocks and sense clocks, and a gate start signal to the gate driver 13 for IDW and BDI.

The timing controller 11 may control the operation of the gate driver 13 on the basis of the gate shift clocks to divide the pixel array into a plurality of first areas and a plurality of second areas to separately drive the pixel array. Each of the first areas and the second areas includes a plurality of pixel lines. The timing controller 11 can simultaneously perform BDI for pixel lines of a certain second area while IDW is sequentially performed for pixel lines of a certain first area. In addition, the timing controller 11 can simultaneously perform BDI for pixel lines of a certain first area while IDW is sequentially performed for pixel lines of a certain second area. Here, the timing controller 11 can generate gate shift clocks such that a pulse period (gate on voltage period) of BDI scan clocks and a pulse period of IDW scan clocks do not overlap. Accordingly, undesirable data mixing (i.e., data collision) between input image data ID and black image data BD can be prevented in a technique for improving MPRT performance by inserting a black image.

The timing controller 11 can simultaneously output a plurality of BDI scan clocks to control BDI to be simultaneously performed for a plurality of pixel lines in a first area or a second area. Accordingly, a insertion time of the black image data BD can be reduced and a sufficient write time of the input image data ID can be secured in the technique for improving the MPRT performance.

The timing controller 11 outputs input image data ID input from the host system 14 to the data driver 12. The timing controller 11 outputs black image data BD which has been internally generated (or predetermined values) to the data driver 12. The black image data BD corresponds to lowest grayscale data of the input image data ID and is used to display a black image during BDI.

The timing controller 11 can modulate input image data ID corresponding to a pixel line (hereafter referred to a first pixel line) having a latest data write timing among pixel lines of an area A included in the first areas (or second areas) into values different from the original values and modulate input image data ID corresponding to a pixel line (hereafter referred to a second pixel line) having an earliest data write timing among pixel lines of an area B included in the first areas (or second areas) into values different from the original values to improve picture quality from deterioration (bright lines and dark lines) due to black image insertion. The timing controller 11 outputs final image data CD including the modulated image data to the data driver 12.

The gate driver 13 generates a scan signal SCAN and a sense signal SEN on the basis of the gate control signal DDC from the timing controller 11. The gate driver 13 generates a scan signal for image writing (hereinafter referred to as an IDW scan signal) and a scan signal for black writing (hereinafter referred to as a BDI scan signal) on the basis of the carry clocks, scan clocks and the sense clocks.

To realize IDW and BDI, the gate driver 13 simultaneously provides the BDI scan signal SCAN to a plurality of first gate lines 17A in a second area (or a first area) while sequentially providing the IDW scan signal SCAN to first gate lines 17A of the first area (or second area). In addition, the gate driver 13 sequentially provides a sense signal for image writing, that is, an IDW sense signal SEN, to second gate lines 17B of the first area (or second area) in synchronization with a timing at which the IDW scan signal SCAN is provided to the first gate lines 17A of the first area (or second area).

The gate driver 13 may be included in a non-display area NA of the display panel 10 in a gate-in-panel (GIP) structure.

The data driver 12 includes a plurality of DACs 121 and a plurality of sensing units (SU) 122. The DACs 121 convert the final input image data CD into IDW data voltages VIDW and convert black image data BD into BDI data voltages VBDI on the basis of the data control signal DDC from the timing controller 11. In addition, the DACs 121 generate a reference voltage and a precharge voltage to be applied to the pixels PXL.

To realize IDW and BDI, the DACs 121 output the IDW data voltages VIDW to the data lines 15 in synchronization with the IDW scan signal SCAN, output the BDI data voltages VBDI to the data lines 15 in synchronization with the BDI scan signal SCAN, and output the reference voltage to the reference voltage lines 16 in synchronization with the IDW sense signal SEN.

Figure 4:
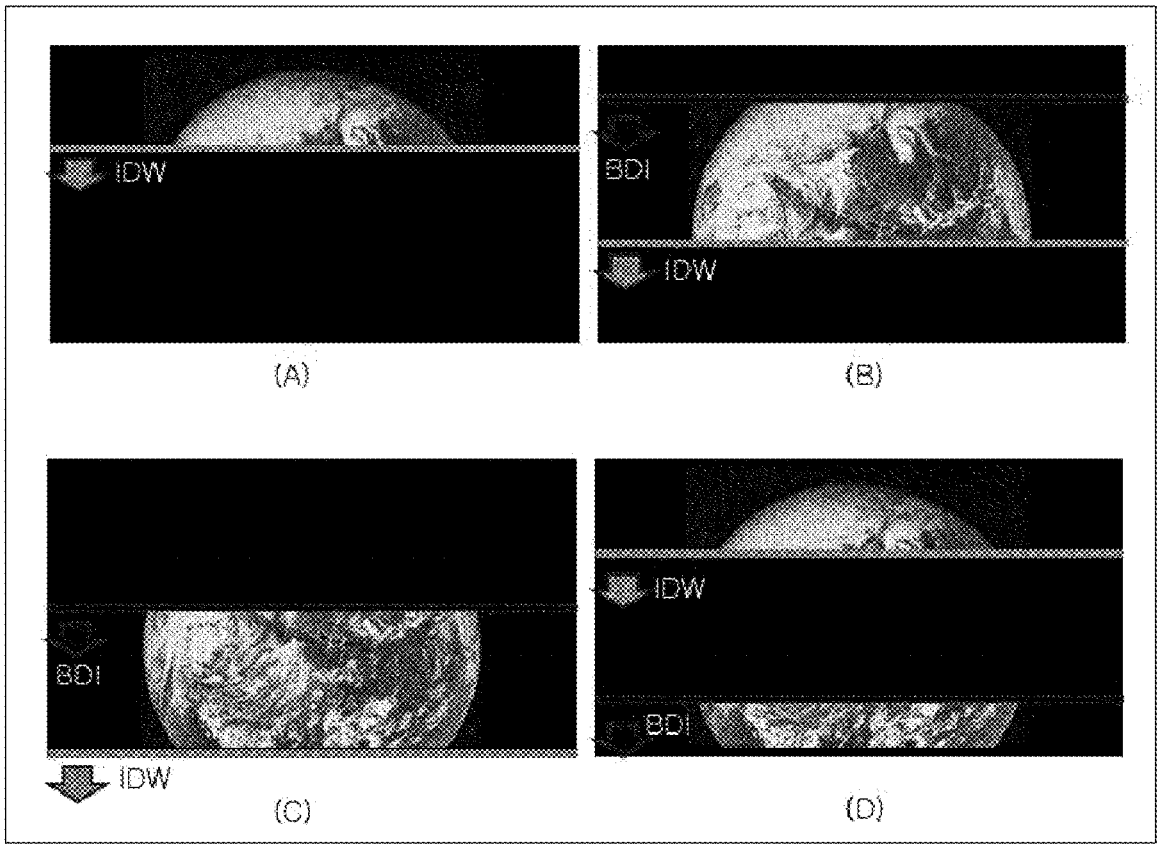
FIGS. 4 to 6 are diagrams showing a black image insertion technique applied to the display device of FIG. 1.
Figure 5:
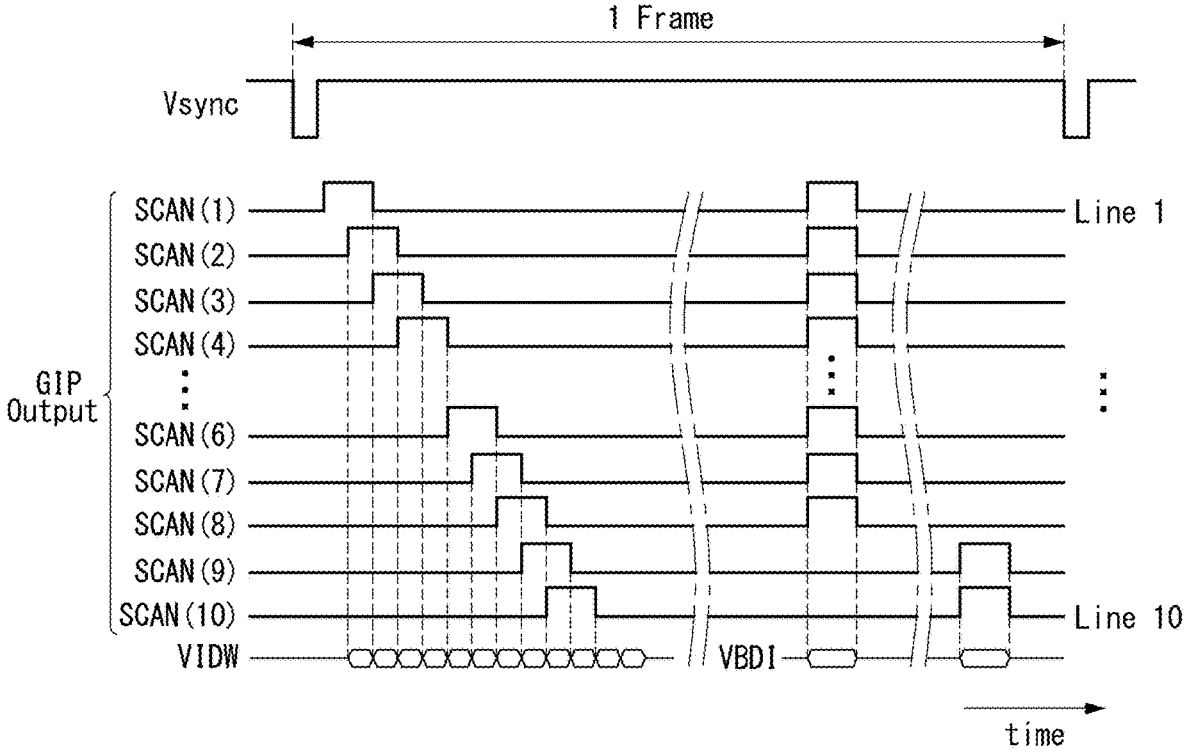
Figure 6:
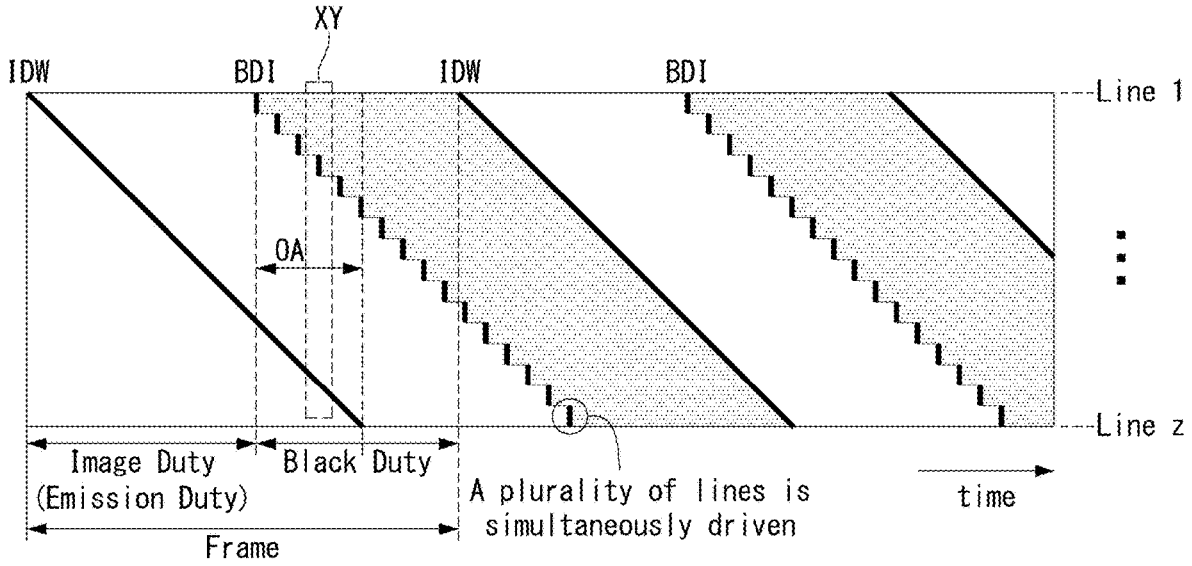

FIGS. 4 to 6 are diagrams showing a black image insertion technique applied to the display device of FIG. 1.

Referring to FIG. 4, IDW and BDI are consecutively performed with a determined time difference therebetween within one frame on the basis of the same pixel line. An emission duty of pixels PXL is determined by a time difference between IDW start timing and BDI start timing within the same frame. The IDW start timing is a fixed factor, whereas the BDI start timing is an adjustable design factor. The IDW start timing is determined by an IDW start signal and the BDI start timing is determined by a BDI start signal. Accordingly, the emission duty of the pixels PXL can be controlled by advancing or delaying an output timing of the BDI start signal to adjust the BDI start timing. When the emission duty of the pixels PXL is determined in this manner, the emission duty is maintained irrespective of frame change. That is, IDW timing and BDI timing for pixel lines are equally shifted while the emission duty is maintained over time.

Referring to FIG. 5, an IDW scan signal SCAN and a BDI scan signal SCAN are provided to the same pixel lines Line 1 to Line 10 with a predetermined time difference corresponding to the emission duty therebetween within one frame. In FIG. 5, the IDW sense signal SEN is omitted for convenience of description. IDW scan signals SCAN (1) to SCAN (10) are phase-shifted in a line sequential manner to select pixel lines Line 1 to Line 10 one by one, and IDW data voltages VIDW are sequentially applied to the selected pixel lines Line 1 to Line 10. BDI scan signals SCAN (1) to SCAN (10) are phase-shifted in a block sequential manner to simultaneously select a plurality of pixel lines among the pixel lines Line 1 to Line 10, and BDI data voltages VBDI are simultaneously applied to the pixel lines Line 1 to Line 10 of a selected block.

Referring to FIG. 6, even if IDW timing and BDI timing for pixel lines Line 1 to Line z change, they can be shifted while maintaining the emission duty. When this driving concept is employed, additional frames for BDI need not be provided and thus it is not necessary to increase a frame rate.

However, since the IDW timing precedes the BDI timing by the emission duty and the IDW timing and the BDI timing have substantially the same shift rate, an overlap period OA in which IDW timing for pixel lines of a first area (or a second area) and BDI timing for the pixel lines of the second area (or the first area) overlap is generated. Pulse periods (gate on voltage periods) of BDI scan clocks and pulse periods of IDW scan clocks may not overlap such that data collision does not occur in the overlap period OA. Accordingly, operations of first, second and third periods which will be described later can be performed.

Figure 7:
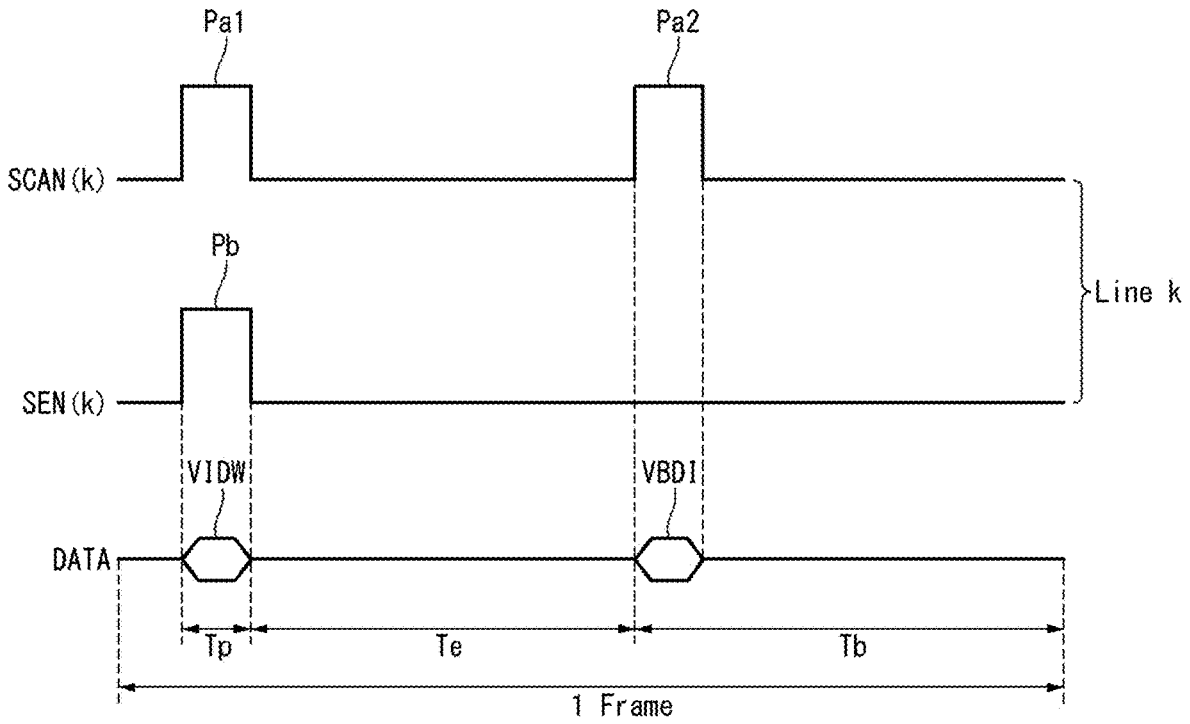
FIG. 7 is a timing diagram of a gate signal and a data signal for realizing IDW and BDI of FIG. 6.
Figure 8A:
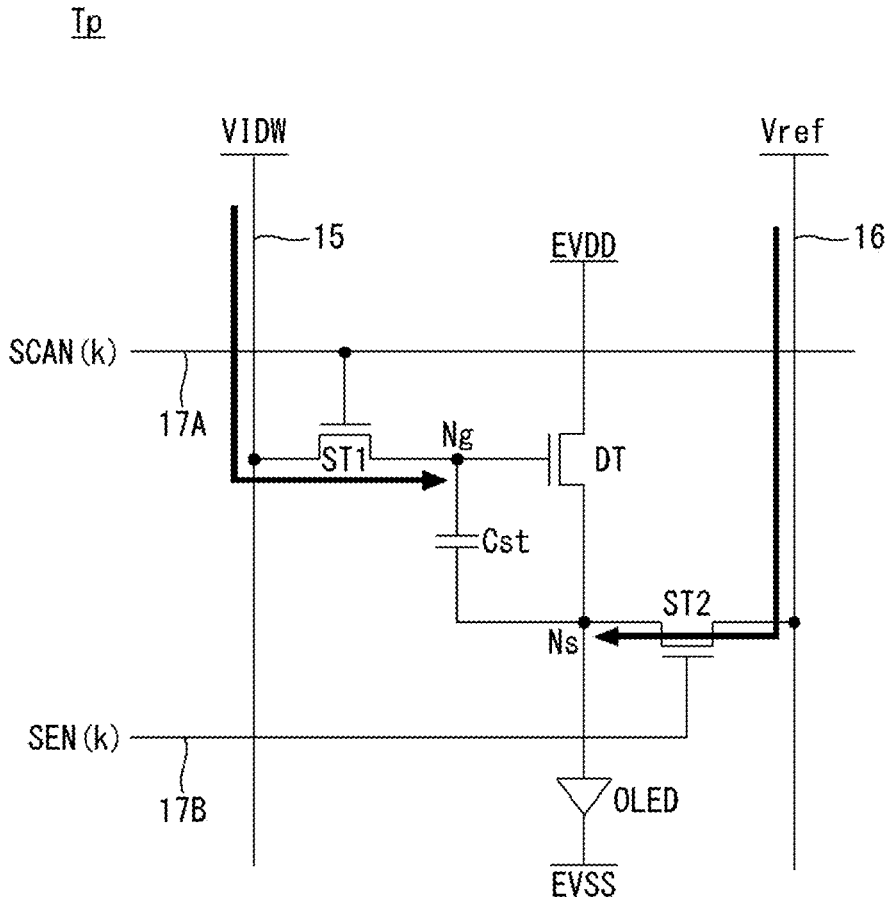
FIG. 8A is an equivalent circuit diagram of a pixel corresponding to a programming period of FIG. 7.
Figure 8B:
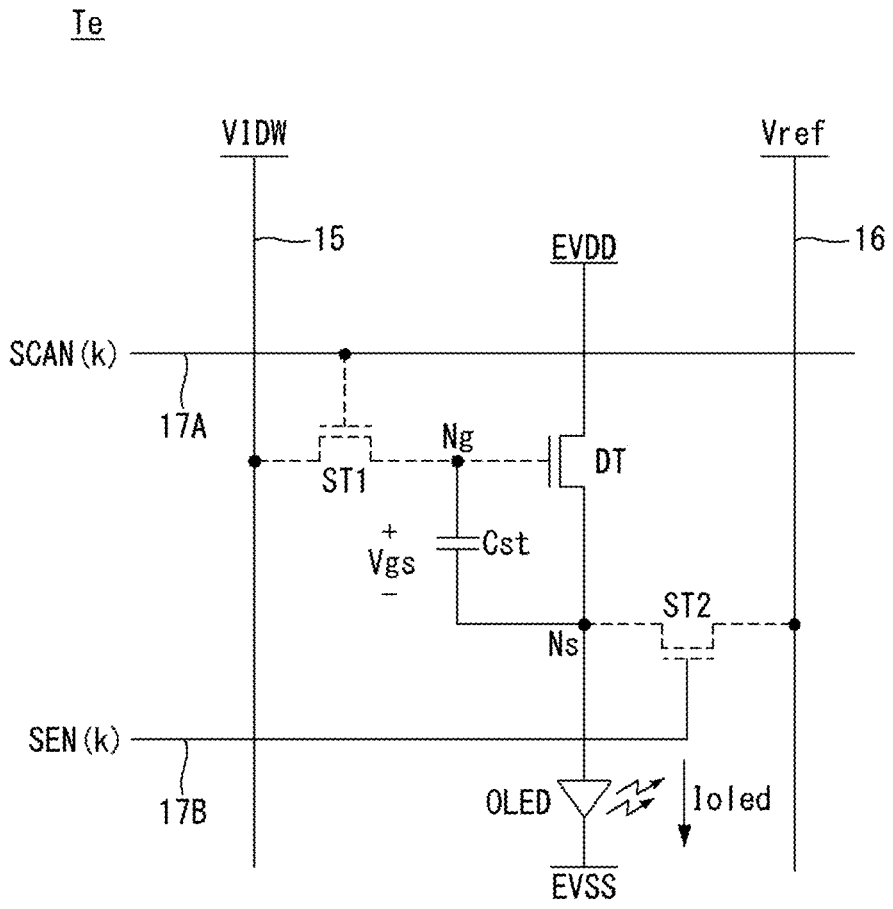
FIG. 8B is an equivalent circuit diagram of the pixel corresponding to an emission period of FIG. 7.
Figure 8C:
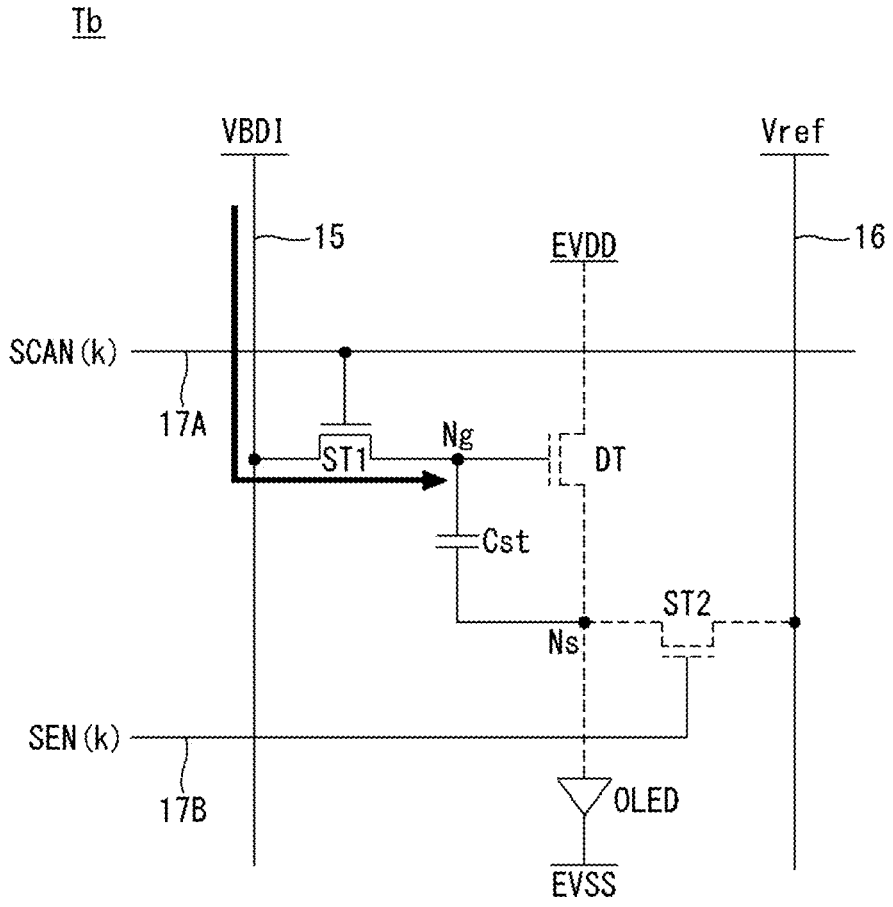
FIG. 8C is an equivalent circuit diagram of the pixel corresponding to a black period of FIG. 7.

FIG. 7 is a timing diagram of a gate signal and a data signal for realizing IDW and BDI of FIG. 6 in a k-th pixel line, FIG. 8A is an equivalent circuit diagram of a pixel corresponding to a programming period of FIG. 7, FIG. 8B is an equivalent circuit diagram of the pixel corresponding to an emission period of FIG. 7, and FIG. 8C is an equivalent circuit diagram of the pixel corresponding to a black period of FIG. 7.

FIG. 7 shows IDW and BDI for a pixel of the k-th pixel line Line k. Referring to FIG. 7, one frame for IDW and BDI includes a programming period Tp in which a voltage between a gate node Ng and a source node Ns is set to be suited to a pixel current for grayscale representation, an emission period Te in which an OLED emits light, and a black period Tb in which light emission of the OLED is stopped. An emission duty may correspond to the emission period Te and a black duty may correspond to the black period Tb. In FIG. 7, the IDW scan signal SCAN is denoted by Pa1, the BDI scan signal SCAN is denoted by Pa2, and the IDW sense signal SEN is denoted by Pb.

Referring to FIGS. 7 and 8A, a first switch TFT ST1 of the pixel is turned on according to the IDW scan signal Pa1 to apply an IDW data voltage VIDW to the gate node Ng in the programming period Tp. A second switch TFT ST2 of the pixel is turned on according to the IDW sense signal Pb to apply a reference voltage Vref to the source node Ns in the programming period Tp. Accordingly, a voltage between the gate node Ng and the source node Ns of the pixel is set to be suited to a desired pixel current in the programming period Tp.

Referring to FIGS. 7 and 8B, the first switch TFT ST1 and the second switch TFT ST2 of the pixel are turned off in the emission period Te. The voltage Vgs between the gate node Ng and the source node Ns which has been preset in the pixel is maintained in the emission period Te. Since the voltage Vgs between the gate node Ng and the source node Ns is higher than the threshold voltage of a driving TFT DT of the pixel, a pixel current holed flows through the driving TFT DT of the pixel during the emission period Te. The electric potential of the gate node Ng and the electric potential of the source node Ns are boosted by the pixel current holed while the voltage Vgs between the gate node Ng and the source node Ns is maintained in the emission period Te. When the electric potential of the source node Ns is boosted to the operating point level of the OLED, the OLED of the pixel emits light.

Referring to FIGS. 7 and 8C, the first switch TFT ST1 of the pixel is turned on according to the BDI scan signal Pa2 to apply a BDI data voltage VBDI to the gate node Ng in the black period Tb. Since the second switch TFT ST2 of the pixel maintains a turn-off state in the black period Tb, the electric potential of the source node Ns maintains the operating point level of the OLED. The BDI data voltage VBDI is lower than the operating point level of the OLED. Accordingly, the voltage Vgs between the gate node Ng and the source node Ns is lower than the threshold voltage of the driving TFT DT in the black period Tb, and thus the pixel current holed does not flow through the driving TFT DT of the pixel and the OLED stops light emission.

Figure 9:
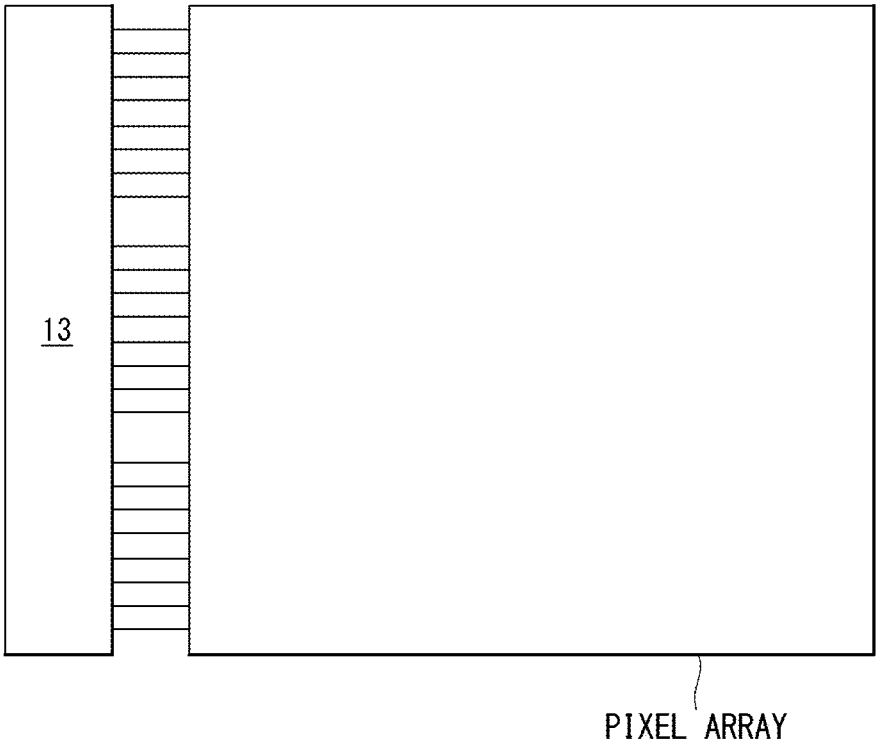
FIG. 9 is a diagram showing an example in which a pixel array of a display panel is divided into a plurality of areas A and a plurality of areas B to be separately driven.
Figure 10:
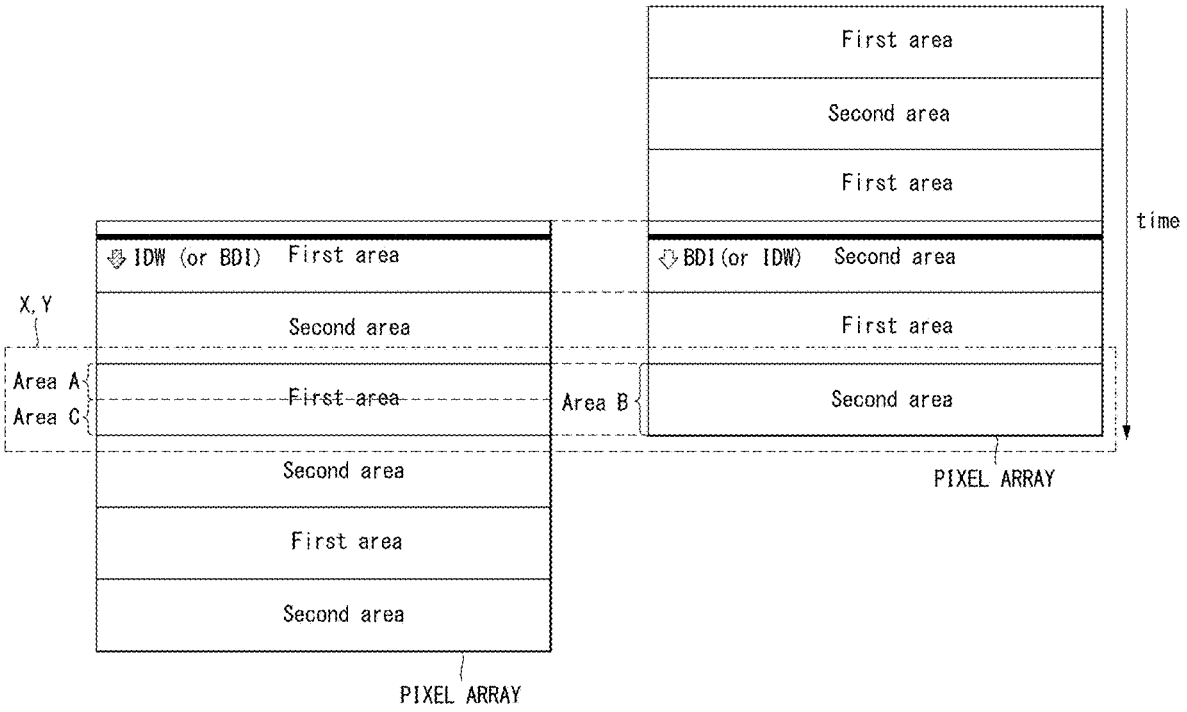
FIG. 10 is a diagram for describing a timing at which IDW is performed for one of areas A and a timing at which BDI is performed for one of areas B.

FIGS. 9 and 10 are diagrams showing an example of dividing the pixel array of the display panel into a plurality of first areas and a plurality of second areas to separately drive the pixel array. Particularly, FIG. 10 is a diagram for describing a timing at which IDW is performed for one of the plurality of first areas and a timing at which BDI is performed for one of the plurality of second areas.

In the pixel array in FIGS. 9 and 10, the first area and the second area can be selectively provided with the IDW scan signal SCAN and the BDI scan signal SCAN from the gate driver 13. Each of the first and second areas may include a plurality of pixel lines and the first area and the second area may have the same number J of pixel lines. Although J is 6 in embodiments of the disclosure, the technical spirit of the disclosure is not limited to the number of pixel lines included in the first and second areas. When the pixel array is divided into a plurality of first areas and a plurality of second areas and driven on the basis of such arrangement, a degree of freedom in design for adjusting an emission duty is improved.

In FIG. 10, a write timing of the IDW data voltage VIDW is sequentially shifted from the uppermost first area of the pixel array according to the IDW start signal and, simultaneously, a write timing of the BDI data voltage VBDI is sequentially shifted from a second area in the middle of the pixel array according to the BDI start signal. Meanwhile, the write timing of the IDW data voltage VIDW may be sequentially shifted from the second area in the middle of the pixel array according to the IDW start signal and, simultaneously, the write timing of the BDI data voltage VBDI is sequentially shifted from the uppermost first area of the pixel array according to the BDI start signal. When BDI according to the BDI start signal is controlled such that it is started in one of the second areas (or first areas) at a timing at which IDW according to the IDW start signal is started in one of the first areas (or second areas), operation can be performed as described above.

Figure 11:
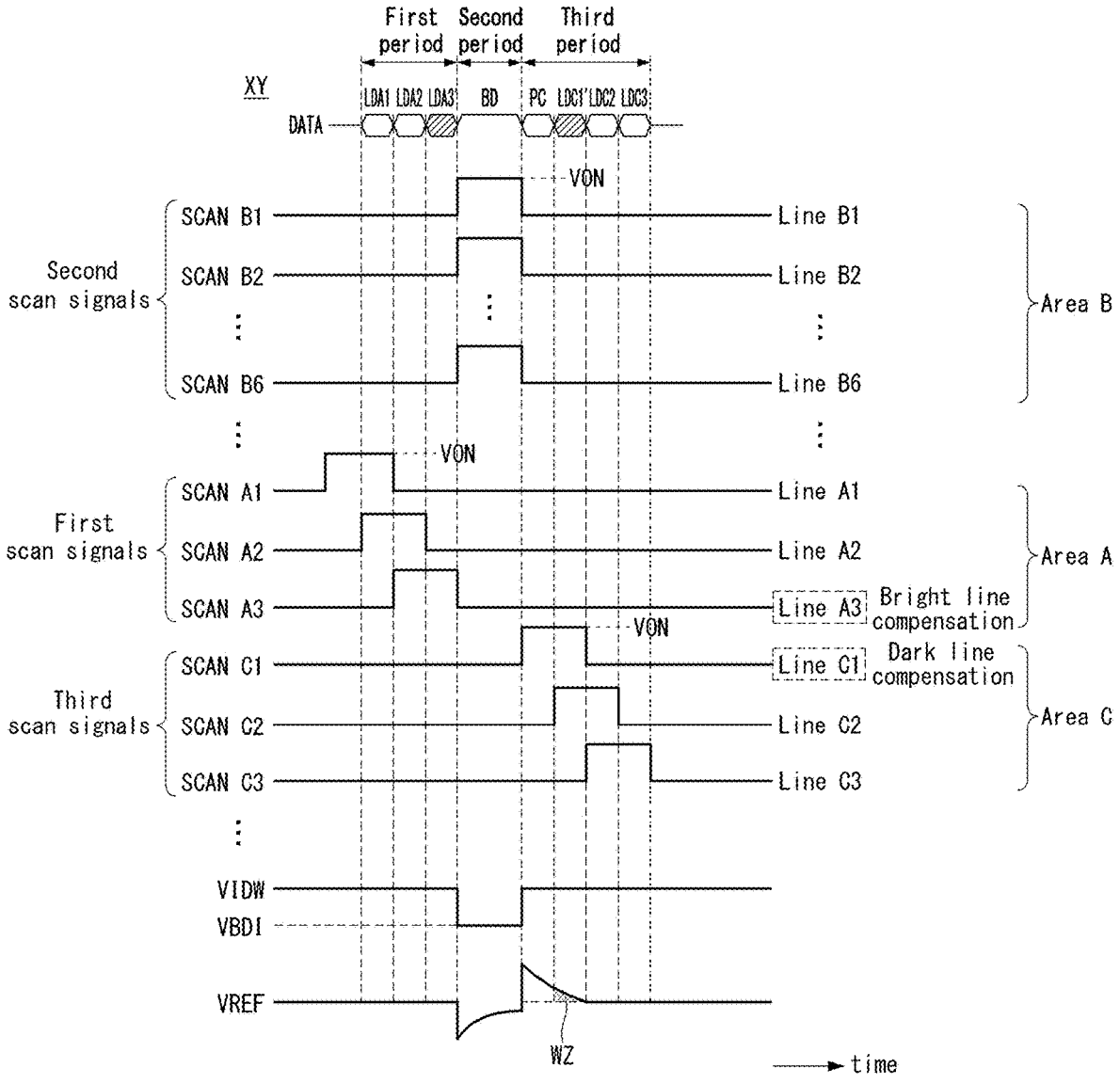
FIG. 11 is a diagram enlarging driving signals with respect to XY of FIG. 6.
Figure 12:
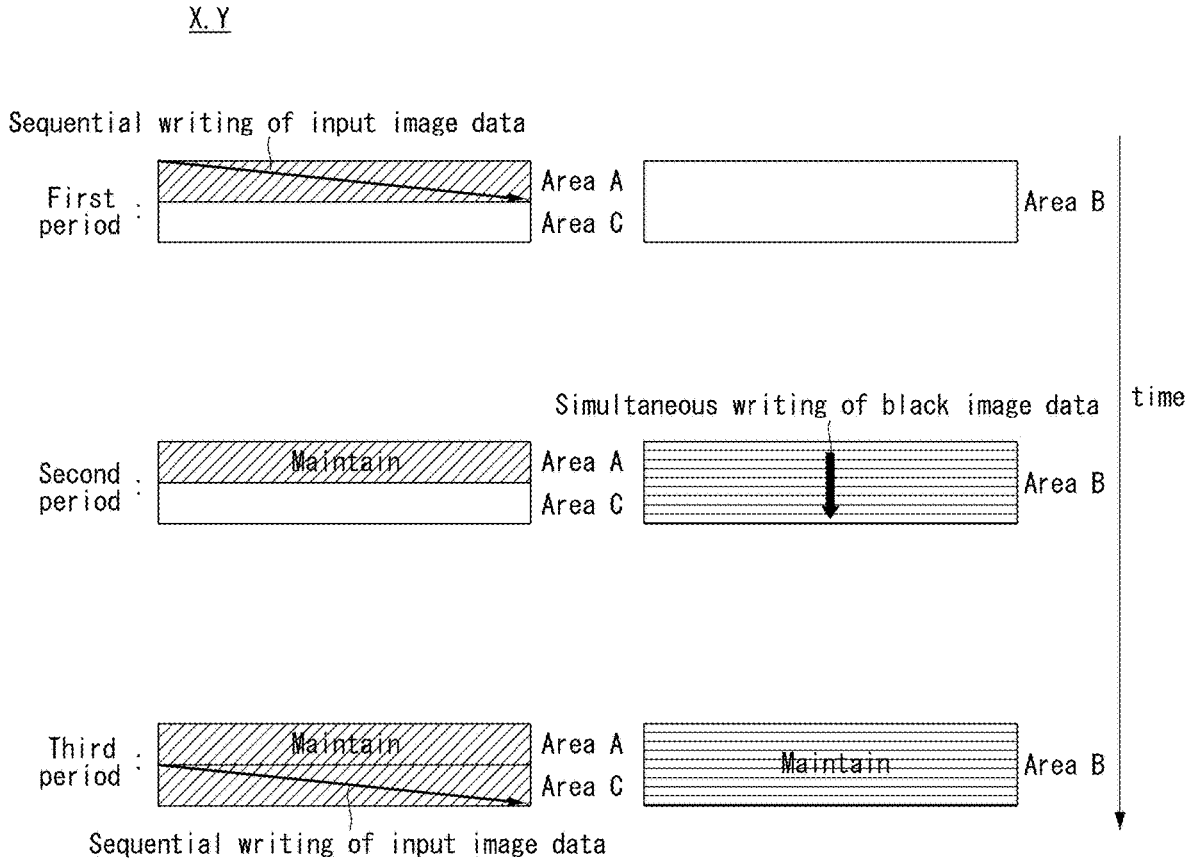
FIG. 12 is a schematic diagram showing a data write order in X and Y of FIG. 10.

To prevent data collision between the IDW data voltage VIDW and the BDI data voltage VBDI, an area (e.g., a first area) to which the IDW data voltage VIDW is applied may be divided into an area A and an area C and separately driven. Here, an area (e.g., a second area) to which the BDI data voltage VBDI is applied becomes an area B. On the other hand, when the IDW data voltage VIDW is applied to the second area and the BDI data voltage is applied to the first area, the second area may be divided into the area A and the area C and separately driven and the first area may become the area B. FIG. 11 is a diagram enlarging driving signals with respect to XY of FIG. 6 and FIG. 12 is a schematic diagram showing a data write order in X and Y of FIG. 10. In addition, FIG. 13 is a diagram showing an example of data modulation capable of improving picture quality from deterioration due to black image insertion.

Figure 13:
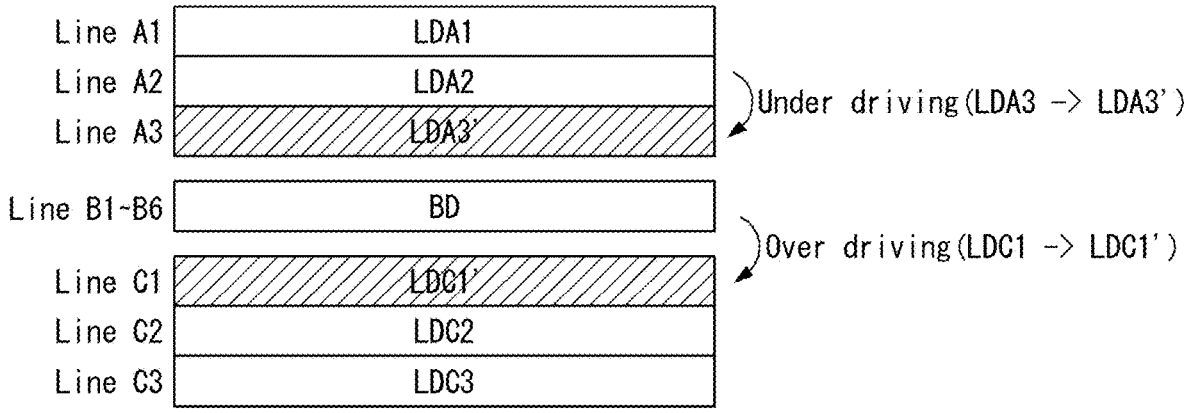
FIG. 13 is a diagram showing an example of data modulation capable of enhancing or improving picture quality from deterioration due to black image insertion.

Referring to FIGS. 11 to 13, BDI can be performed for pixel lines B1 to B6 of a second area while IDW is performed for pixel lines A1 to A3 and C1 to C3 of a first area, for example. In this case, the first area is divided into an area A and an area C and separately driven and the second area becomes an area B.

To this end, the panel drivers sequentially write input image data LDA1, LDA2 and LDA3' to pixel lines Lines A1 to A3 included in the area A in a first period, simultaneously write black image data BD to all pixel lines Lines B1 to B6 included in the area B in a second period following the first period, and sequentially write input image data LDC1', LDC2 and LDC3 to all pixel lines Lines C1 to C3 included in the area C in a third period following the second period.

Here, since the first period, the second period and the third period are included in one frame period, the present disclosure can be used to enhance or optimize for high-speed operation and can be used to solve a problem of insufficient input image charging time and improve a motion picture response speed using the black image insertion at the same time. In addition, since the second period does not overlap with the first period and the third period, the present disclosure can prevent undesirable data mixing (i.e., data collision) between input image data ID and black image data BD in the overlap period OA.

The panel drivers sequentially apply first scan signals SCAN A1 to SCAN A3 synchronized with write timings of the input image data LDA1, LDA2 and LDA3' to the pixel lines Lines A1 to A3 of the area A during the first period, simultaneously apply second scan signals SCAN B1 to SCAN B6 synchronized with a write timing of the black image data BD to the pixel lines Lines B1 to B6 of the area B during the second period, and sequentially apply third scan signals SCAN C1 to SCAN C3 synchronized with write timings of the input image data LDC1', LDC2 and LDC3 to the pixel lines Lines C1 to C3 of the area C during the third period.

Here, halves of gate on voltage (VON) periods (pulse periods) of the first scan signals SCAN A1 to SCAN A3 overlap between neighboring phases, gate on voltage (VON) periods of the second scan signals SCAN B1 to SCAN B6 completely overlap, and halves of gate on voltage (VON) periods of the third scan signals SCAN C1 to SCAN C3 overlap between neighboring phases. In the first and third scan signals, the first half of the gate on voltage (VON) period corresponds to a precharge period and the last half thereof corresponds to a charge period. When scan signals are partially overlapped such that a precharge period is provided in advance of a charge period, the IDW data voltage VIDW can be rapidly charged to a desired level in each pixel. Data charged in each pixel in a precharge period is data to be written to another pixel. Each pixel is precharged with data of another pixel of a previous pixel line and then charged with data thereof. However, pixels of a pixel line Line C1 of the area C is precharged with additional precharge data PC. This is because the third scan signal SCAN C1 applied to the pixel line Line C1 of the area C does not overlap with the first scan signal SCAN A3 applied to the previous pixel line Line A3 of the area A. The precharge data PC corresponds to a precharge voltage generated in the DAC 121 of FIG. 2. The precharge data PC may have a gray scale higher than the black image data BD and lower than the input image data LDC1' to be applied to the corresponding pixel.

To prevent undesired data mixing between the input image data ID and the black image data BD, the gate on voltage (VON) periods of the second scan signals SCAN B1 to SCAN B6 do not overlap with the gate on voltage (VON) periods of the first scan signals SCAN A1 to SCAN A3 and do not overlap with the gate on voltage (VON) periods of the third scan signals SCAN C1 to SCAN C3.

Accordingly, the first scan signal SCAN A3 applied to the first pixel line Line A3 having the latest data write timing among the pixel lines Lines A1 to A3 of the area A does not overlap with the second scan signal SCAN C1 applied to the second pixel line Line C1 having the earliest data write timing among the pixel lines Lines C1 to C3 of the area C. That is, the charge period of the current stage overlaps with the precharge period of the following stage in the pixel lines Lines A1 and A2 of the area A other than the first pixel line Line A3, whereas the charge period of the current stage does not overlap with the precharge period of the following stage in the first pixel line Line A3. Only one pixel line Line A3 is connected to data lines in the charge period for the first pixel line Line A3, whereas other pixel lines Lines A1 and A2 of the area A are connected to the data lines in the charge periods therefor. A load applied to the data lines in the charge period for the first pixel line Line A3 is reduced to half the load applied to the data lines in the charge period for each of the other pixel lines Lines A1 and A2 of the area A. Voltages charged in pixels of each pixel line vary according to load applied to the data lines. Accordingly, when the same data voltage VIDW is charged, a charge amount of the pixels of the first pixel line Line A3 becomes larger than a charge amount of the pixels of each of the other pixel lines Lines A1 and A2 of the area A and thus the first pixel line Line A3 may be seen as a bright line.

Meanwhile, since the data lines are connected to the reference voltage lines through parasitic capacitors, electric potentials of the reference voltage lines vary according to the capacitor coupling effect. That is, the electric potentials of the reference voltage lines decrease to be lower than a reference voltage VREF in synchronization with decrease of the electric potentials of the data lines to the BDI data voltage VBDI at a second period start time. In addition, the electric potentials of the reference voltage lines increase to be higher than the reference voltage VREF in synchronization with increase of the electric potentials of the data lines to the IDW data voltage VIDW at a second period end time. The luminance realized in each pixel is determined by the gate-source voltage of the driving TFT, that is, a difference voltage between the IDW data voltage VIDW and the reference voltage VREF. When the reference voltage VREF is high, the gate-source voltage of the driving TFT and a pixel current according thereto decrease and thus the luminance decreases. Specifically, in the case of the second pixel line Line C1 having the earliest data write timing among the pixel lines Lines C1 to C3 of the area C, the reference voltage VREF is higher than those of other pixel lines Lines C2 and C3 of the area C. Accordingly, pixel current flowing through the pixels of the second pixel line Line C1 is less than pixel current flowing through the pixels of each of the other pixel lines Lines C2 and C3 of the area A and thus the second pixel line Line C1 may be seen as a dark line.

To prevent the first pixel line Line A3 from being seen as a bright line and prevent the second pixel line Line C1 from being seen as a dark line, the timing controller 11 downwardly modulates an original value LDA3 of input image data to be written to the first pixel line Line A3 to a value different from the original value LDA3, that is, a modulated value LDA3' less than the original value LDA3, and upwardly modulates an original value LDC1 of input image data to be written to the second pixel line Line C1 to a value different from the original value LDC1, that is, a modulated value LDC1' greater than the original value LDC1, as shown in FIG. 13.

The timing controller 11 can be aware of the first pixel line Line A3 and the second pixel line Line C1 through line count information. The timing controller 11 can solve the problems that the first pixel line Line A3 is seen as a bright line and the second pixel line Line C1 is seen as a dark line by writing the downwardly modulated data LDA3' to the first pixel line Line A3 and writing the upwardly modulated data LDC1' to the second pixel line Line C1 through the panel drivers.

Figure 14:
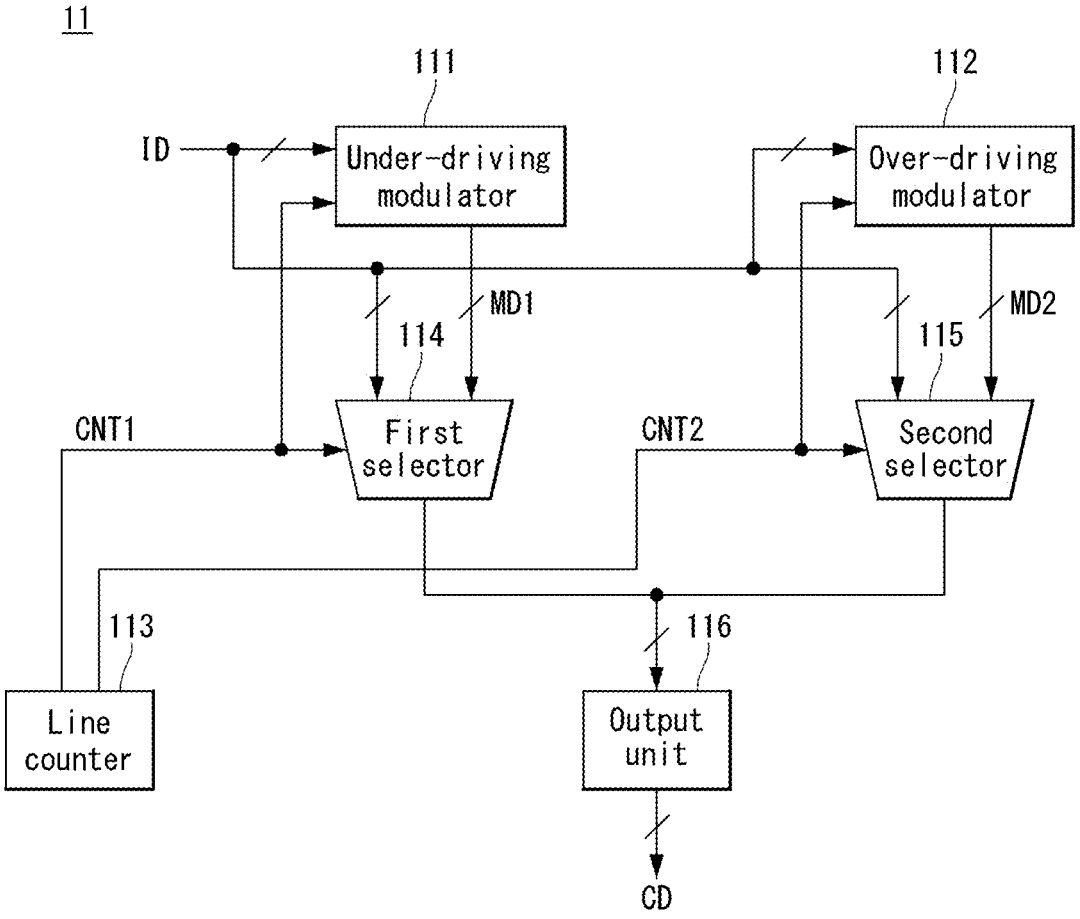
FIG. 14 is a diagram showing an internal configuration of a timing controller for realizing FIG. 13.
Figure 15:
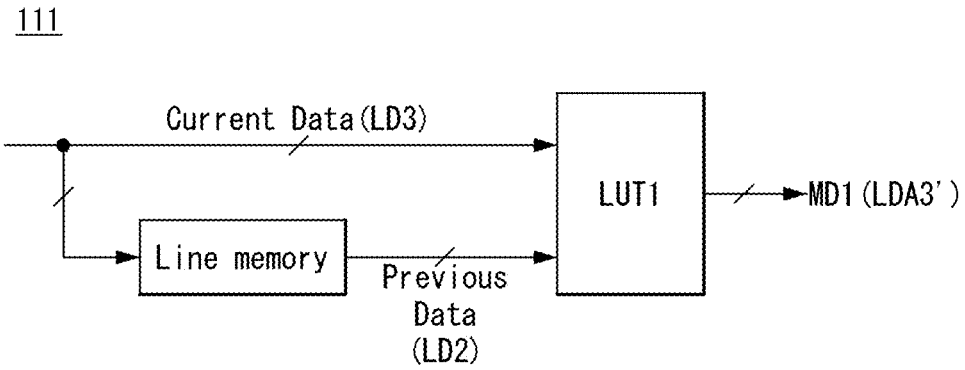
FIG. 15 is a diagram showing an under-driving modulator of FIG. 14.

FIG. 14 is a diagram showing an internal configuration of the timing controller for realizing FIG. 13 and FIG. 15 is a diagram showing an under-driving modulator of FIG. 14. In addition, FIG. 16 is a diagram showing an over-driving modulator of FIG. 14.

Figure 16:
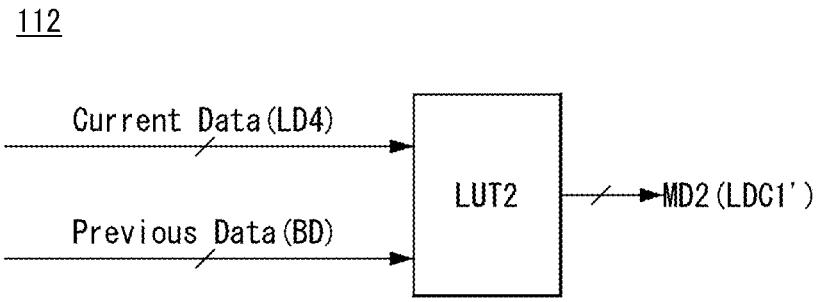
FIG. 16 is a diagram showing an over-driving modulator of FIG. 14.

Referring to FIGS. 14 to 16, the timing controller 11 includes an under-driving modulator circuit 111 (which may be referred to herein as an under-driving modulator 111), an over-driving modulator circuit 112 (which may be referred to herein as an over-driving modulator 112), a line counter circuit 113 (which may be referred to herein as line counter 113), a first selector circuit 114 (which may be referred to herein as a first selector 114), a second selector 115 (which may be referred to herein as a second selector 115), and an output circuit 116 (which may be referred to herein as an output unit 116). In various embodiments, each of the under-driving modulator 111, over-driving modulator 112, line counter 113, first selector 114, second selector 115 and output unit 116 may include electrical circuitry, features, components, or the like configured to perform the various operations described herein with respect to the under-driving modulator 111, over-driving modulator 112, line counter 113, first selector 114, second selector 115 and output unit 116.

The under-driving modulator 111 compares input image data LDA2 to be written to a pixel line Line A2 neighboring the first pixel line Line A3 among the pixel lines Lines A1 to A3 of the area A with input image data LDA3 corresponding to the first pixel line Line A3 on a pixel-by-pixel basis and downwardly modulates the original value LDA3 of input image data to be written to the first pixel line Line A3 to a modulated value LDA3' less than the original value LDA3.

To this end, the under-driving modulator 111 may include a line memory and a first compensation table LUT1 as shown in FIG. 15. Compensation values for preventing generation of bright lines which correspond to results of comparison between current data and previous data are recorded in the first compensation table LUT1. The under-driving modulator 111 applies the input image data LDA3 corresponding to the first pixel line Line A3 to the first compensation table LUT1 as current data and applies the input image data LDA2 to be written to the neighboring pixel line Line A2 stored in the line memory to the first compensation table LUT1 as previous data. In various embodiments, the line memory may be or include any electrical circuitry, features, components, or the like suitable to store input image data as previous data. In some embodiments, the line memory may be or include any computer-readable memory or storage buffer.

When the input image data LDA3 corresponding to the first pixel line Line A3 is larger than the input image data LDA2 to be written to the neighboring pixel line Line A2, the under-driving modulator 111 relatively increases a downward modulation width for the input image data LDA3 corresponding to the first pixel line Line A3. On the other hand, when the input image data LDA3 corresponding to the first pixel line Line A3 is equal to or smaller than the input image data LDA2 to be written to the neighboring pixel line Line A2, the under-driving modulator 111 relatively decreases the downward modulation width for the input image data LDA3 corresponding to the first pixel line Line A3. Accordingly, the problem with respect to the bright line appearing in the first pixel line Line A3 can be effectively solved.

The over-driving modulator 112 compares black image data BD to be written to the pixel lines Lines B1 to B6 of the area B with input image data LDC1 corresponding to the second pixel line Line C1 of the area C on a pixel-by-pixel basis and upwardly modulates the original value LDC1 of input image data to be written to the second pixel line Line C1 to a modulated value LDC1' greater than the original value LDC1.

To this end, the over-driving modulator 112 may include a second compensation table LUT2 as shown in FIG. 16. Compensation values for preventing generation of dark lines which correspond to results of comparison between current data and previous data are recorded in the second compensation table LUT2. The over-driving modulator 112 applies the input image data LDC1 corresponding to the second pixel line Line C1 to the second compensation table LUT2 as current data and applies the black image data BD to the second compensation table LUT2 as previous data.

The over-driving modulator 112 increases an upward modulation width for the input image data LDC1' to be written to the second pixel line Line C1 as a difference between the input image data LDC1 corresponding to the second pixel line Line C1 and the black image data BD increases. Accordingly, the problem with respect to the dark line appearing in the second pixel line Line C1 can be effectively solved.

The line counter 113 counts the pixel lines Lines A1 to A3 of the area A and the pixel lines Lines C1 to C3 of the area C and outputs first line count information CNT1 about the pixel lines Lines A1 to A3 of the area A and second line count information CNT2 about the pixel lines Lines C1 to C3 of the area C.

The first selector 114 selects the downwardly modulated data LDA3' from the under-driving modulator 111 as input image data to be written to the first pixel line Line A3 when the first line count information CNT1 corresponds to the first pixel line Line A3 of the area A, and selects input image data LDA1 and LDA2 which is not modulated as input image data to be written to the pixel lines Lines A1 and A2 when the first line count information CNT1 corresponds to the pixel lines Lines A1 and A2 other than the first pixel line Line A3.

The second selector 115 selects the upwardly modulated data LDC1' from the over-driving modulator 112 as input image data to be written to the second pixel line Line C1 when the second line count information CNT2 corresponds to the second pixel line Line C1 of the area C, and selects input image data LDC2 and LDC3 which is not modulated as input image data to be written to the pixel lines Lines C2 and C3 when the second line count information CNT2 corresponds to the pixel lines Lines C2 and C3 other than the second pixel line Line C1.

The output unit 116 outputs the input image data from the first selector 114 and the second selector 115 to the data driver 12 as final image data CD. In various embodiments, the output unit 116 may include any electrical circuitry suitable for outputting the input image data from the first selector 114 and the second selector 115 to the data driver 12 as final image data CD, and in some embodiments, the output unit 116 may include a buffer circuit, a latch circuit, a digital-to-analog converter, an analog-to-digital converter, and the like.

According to the embodiments of the present disclosure, the following effects are obtained.

The present disclosure divides a display panel into a plurality of areas A and a plurality of areas B, each including a plurality of pixel lines to separately drive the display panel. That is, the present disclosure sequentially writes input image data to some pixel lines included in an area A during a first period, simultaneously writes black image data to all pixel lines included in an area B in a second period following the first period, and sequentially writes input image data to the remaining pixel lines included in the area A in a third period following the second period within one frame period. Accordingly, the present disclosure can be optimized for high-speed operation and can solve a problem of insufficient input image charging time in improvement of a motion picture response speed according to black image insertion.

Furthermore, the present disclosure can downwardly modulate the original value of input image data corresponding to a first pixel line having a latest data write timing among some pixel lines of the area A to a modulated valueless than the original value and upwardly modulate the original value of input image data corresponding to a second pixel line having an earliest data write timing among the remaining pixel lines of the area A to a modulated value greater than the original value, improving picture quality from deterioration (bright lines and dark lines) due to black image insertion.

The effects that can be achieved with the disclosure are not limited to what has been particularly described hereinabove and various effects are included in the disclosure.

It will be understood by those skilled in the art that the disclosure can be changed and modified in various manners without departing from the technical spirit of the disclosure through the above description.

The various embodiments described above can be combined to provide further embodiments. Further changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device, comprising:

a display panel including an area A, an area B, and an area C, the display panel having a plurality of pixel lines in each of the area A, the area B, and the area C, and the display panel being driven in periods including at least a first period, a second period, and a third period;

a timing controller for modulating a third input image data corresponding to a specific first pixel line having a latest data write timing among the pixel lines of the area A to a modulated third input image data different from the third input image data, and modulating a fourth input image data corresponding to a specific second pixel line having an earliest data write timing among the pixel lines of the area C to a modulated fourth input image data different from the fourth input image data; and a panel driver for:

sequentially writing each of a first input image data, a second input image data, and the modulated third input image data to a respective pixel line of the pixel lines of the area A during the first period, the modulated third input image data being written to the specific first pixel line of the area A, simultaneously writing black image data to the pixel lines of the area B of the display panel during the second period following the first period, and sequentially writing each of the modulated fourth input image data, a fifth input image data, and a sixth input image data to a respective pixel line of pixel lines of the area C during the third period following the second period, the modulated fourth input image data being written to the specific second pixel line of the area C.

2. The display device of claim 1, wherein the first period, the second period and the third period are included in one frame period.

3. The display device of claim 1, wherein the black image data includes low grayscale image data for displaying a black image on the display panel.

4. The display device of claim 1, wherein the timing controller is configured to downwardly modulate a first value of the third input image data to a modulated first value of the modulated third input image data, and wherein the modulated first value is less than the first value.

5. The display device of claim 4, wherein the timing controller includes an under-driving modulator for comparing a third value of the second input image data with the first value of the third input image data on a pixel-by-pixel basis and downwardly modulating the first value of the third input image data to the modulated first value.

6. The display device of claim 5, wherein the under-driving modulator is configured to relatively increase a downward modulation width for the first value of the third input image data when the first value of the third input image data is greater than the third value of the second input image data, and relatively decreases the downward modulation width for the first value of the third input image data when the first value of the third input image data is equal to or less than the third value of the second input image data.

7. The display device of claim 6, wherein the timing controller further comprises:

a line counter for counting the pixel lines of the area A and outputting a first line count information about the pixel lines of the area A;

a first selector for selecting downwardly modulated data from the under-driving modulator as the modulated third input image data to be written to the specific first pixel line when the first line count information corresponds to the specific first pixel line, and selecting the first input image data and the second input image data which are not modulated as the first input image data and the second input image data to be written to the other pixel lines of the area A other than the specific first pixel line when the first line count information corresponds to the other pixel lines; and an output unit for providing the first input image data, the second input image data, and the modulated third input image data for the pixel lines of the area A from the first selector to the panel driver.

8. The display device of claim 1, wherein the timing controller is configured to upwardly modulate a second value of the fourth input image data to a modulated second value of the modulated fourth input image data, and wherein the modulated second value is greater than the second value.

9. The display device of claim 8, wherein the timing controller includes an over-driving modulator for comparing the black image data to be written to pixel lines of the area B with the second value of the fourth input image data on a pixel-by-pixel basis and upwardly modulating the second value of the fourth input image data to the modulated second value.

10. The display device of claim 9, wherein the over-driving modulator is configured to increase an upward modulation width for the second value of the fourth input image data as a difference between the second value of the fourth input image data and the black image data increases.

11. The display device of claim 10, wherein the timing controller further comprises:

a line counter for counting the pixel lines of the area C and outputting a second line count information about the pixel lines of the area C;

a second selector for selecting upwardly modulated data from the over-driving modulator as the modulated fourth input image data to be written to the specific second pixel line when the second line count information corresponds to the specific second pixel line, and selecting the fifth input image data and the sixth input image data which are not modulated as the fifth input image data and the sixth input image data to be written to the other pixel lines of the area C other than the specific second pixel line when the second line count information corresponds to the other pixel lines; and an output unit for providing the modulated fourth input image data, the fifth input image data, and the sixth input image data from the second selector to the panel driver.

12. The display device of claim 1, wherein the panel driver sequentially applies first scan signals synchronized with write timings of the first input image data, the second input image data, and the modulated third input image data to the pixel lines of the area A during the first period, simultaneously applies second scan signals synchronized with a write timing of the black image data to the pixel lines of the area B during the second period, and sequentially applies third scan signals synchronized with write timings of the modulated fourth input image data, the fifth input image data, and the sixth input image data to the pixel lines of the area C during the third period, wherein halves of gate on voltage periods of the first scan signals overlap between neighboring phases, gate on voltage periods of the second scan signals completely overlap each other, and halves of gate on voltage periods of the third scan signals overlap between neighboring phases.

13. The display device of claim 12, wherein the gate on voltage periods of the second scan signals are non-overlapping with the gate on voltage periods of the first scan signals and are non-overlapping with the gate on voltage periods of the third scan signals.

14. The display device of claim 13, wherein the panel driver writes precharge data to the specific second pixel line in advance of the modulated fourth input image data.

15. The display device of claim 14, wherein the precharge data has a gray scale higher than that of the black image data and lower than that of the modulated fourth input image data.

16. A method of driving a display device including a display panel having a plurality of pixel lines disposed thereon and driven in periods including at least a first period, a second period and a third period, the method comprising:

modulating a third input image data corresponding to a specific first pixel line having a latest data write timing among a plurality of pixel lines of an area A of the display panel to a modulated third input image data different from the third input image data, and modulating a fourth input image data corresponding to a specific second pixel line having an earliest data write timing among a plurality of pixel lines of an area C of the display panel to a modulated fourth input image data different from the fourth input image data; and sequentially writing each of a first input image data, a second input image data, and the modulated third input image data to a respective pixel line of the pixel lines included in the area A during a first period, the modulated third input image data being written to the specific first pixel line of the area A, simultaneously writing black image data to a plurality of pixel lines included in the area B of the display panel during a second period following the first period, and sequentially writing each of the modulated fourth input image data, a fifth input image data, and a sixth input image data to a respective pixel line of the pixel lines included in the area C during a third period following the second period, the modulated fourth input image data being written to the specific second pixel line of the area C.

17. A display device, comprising:

a display panel including an area A, an area B, and an area C, each of the area A, the area B, and the area C including a plurality of pixel lines;

a timing controller configured to:

modulate a third input image data corresponding to a specific first pixel line having a latest data write timing among the pixel lines of the area A to a modulated third input image data different from the third input image data, and modulate a fourth input image data corresponding to a specific second pixel line having an earliest data write timing among the pixel lines of the area C to a modulated fourth input image data different from the fourth input image data; and a panel driver configured to:

supply each of a first input image data, a second input image data, and the modulated third input image data sequentially to a respective pixel line of the plurality of pixel lines in the area A during a first period, the modulated third input image data being supplied to the specific first pixel line of the area A, supply black image data simultaneously to the plurality of pixel lines in the area B during a second period following the first period, and supply each of the modulated fourth input image data, a fifth input image data, and a sixth input image data sequentially to a respective pixel line of the plurality of pixel lines in the area C during a third period following the second period, the modulated fourth input image data being supplied to the specific second pixel line of the area C.

18. The display device of claim 17, wherein the timing controller is configured to:

modulate the third input image data to the modulated third input image data based on a first compensation table; and modulate the fourth input image data to the modulated fourth input image data based on a second compensation table.

* * * * *